US005163855A

United States Patent [19]

Gerke et al.

[11] Patent Number: 5,163,855

[45] Date of Patent: Nov. 17, 1992

[54] CONNECTOR BANK FOR TELECOMMUNICATION SYSTEMS

[75] Inventors: Dieter Gerke; Andrzey Janczak, both of Berlin, Fed. Rep. of Germany

[73] Assignee: Krone Aktiengesellschaft, Berlin, Fed. Rep. of Germany

[21] Appl. No.: 694,119

[22] Filed: May 1, 1991

[30] Foreign Application Priority Data

May 10, 1990 [DE] Fed. Rep. of Germany ..... 4015238

[51] Int. Cl.[5] ..... H01R 9/22

[52] U.S. Cl. ..... 439/709; 439/395

[58] Field of Search ..... 439/708, 709, 720, 721, 439/722, 395, 398

[56] References Cited

U.S. PATENT DOCUMENTS

| | | | |
|---|---|---|---|
| 3,673,542 | 6/1972 | Di Stefano et al. | 439/708 |
| 4,230,391 | 10/1980 | Keglewitsch | 439/395 |
| 4,533,200 | 8/1985 | Wilson | 439/395 |
| 4,533,202 | 8/1985 | Pohl | 439/638 |
| 4,548,448 | 10/1985 | Ellison et al. | 439/75 |
| 4,846,735 | 7/1989 | Teichler et al. | 439/709 |
| 4,997,385 | 3/1991 | Casagrande | 439/259 |

FOREIGN PATENT DOCUMENTS

| | | |
|---|---|---|
| 2452402 | 5/1976 | Fed. Rep. of Germany . |
| 2708175 | 9/1977 | Fed. Rep. of Germany . |
| 2952599C2 | 2/1984 | Fed. Rep. of Germany . |
| 3730662A1 | 3/1989 | Fed. Rep. of Germany . |

*Primary Examiner*—Larry I. Schwartz
*Assistant Examiner*—Hien D. Vu
*Attorney, Agent, or Firm*—McGlew & Tuttle

[57] ABSTRACT

The invention relates to a connector bank for telecommunication systems comprising connecting elements 4, 25, 26 for cable wires and comprising contact elements 10 for electrical connection of the connecting elements 4, 25, 26 with the circuit tracks of a printed-circuit board 20.

The arrangement prevents damage due to connecting forces which are otherwise transferred to the contact elements when connecting the cable wires to the connecting elements 4, 25, 26. According to the invention the contact elements 10 are provided as separate components of a contact pin 11 and of a plug connector member 12 being formed as one piece therewith for connection with the connecting elements 4, 25, 26.

12 Claims, 4 Drawing Sheets

CONNECTOR BANK FOR TELECOMMUNICATION SYSTEMS

FIELD OF THE INVENTION

The invention relates generally to a connector bank for telecommunication systems and more particularly to a connector bank for telecommunication systems including connecting elements for cable wires and contact elements for electrical connection of the connecting elements with circuit tracks of a printed-circuit board.

BACKGROUND OF THE INVENTION

A connector bank of the mentioned species is known in the art from DE 37 30 662 A1. Therein, the contact elements are formed as solder pins at the connecting elements, and these pins penetrate a bottom opening of the plastic housing of the connector bank. These pins are then soldered in boreholes of a printed-circuit board for electrical connection of the connecting elements with the circuit tracks of the printed-circuit board. Each terminal position of a connector bank must, during an operation period of many years, be connected and disconnected up to 200 times. When connecting cable wires to the connecting elements, the contact elements of which are soldered in boreholes of the printed-circuit board, high connect forces will occur when pressing the cable wires into the cutting/clamping contact slots of the connecting elements. When disconnecting cable wires from the connecting elements, there are correspondingly lower disconnect forces. As the connecting elements, because of manufacturing tolerances, can move within the housing of the connector bank, the contact elements are not capable of always being supported on the housing during connection and disconnection. Thus, all connect and disconnect forces act directly on the solder position between the contact element and the printed-circuit board. When connect and disconnect forces are too high, either the solder position or the printed circuit board or the circuit tracks thereof, can be damaged near to the solder position. A consequence thereof are contact interruptions because of fine cracks and potential destruction of the solder position.

SUMMARY AND OBJECTS OF THE INVENTION

It is an object of the invention to provide a connector bank of the mentioned species for which there is no risk of contact interruption between the contact element and the circuit track with multiple connect and disconnect operations of cable wires at the associated connecting elements.

According to the invention, a connector bank for telecommunication systems is provided including connecting elements for connection with cable wires and including contact elements for electrical connection of the connecting elements with a circuit track of a printed-circuit board. The arrangement according to the invention includes contact elements which are provided as a separate component including a contact pin and a plug connector member formed in one piece for providing a connection between the connecting elements and the circuit tracks of the printed-circuit board. The plug connector member is preferably formed as a fork-type contact. The contact pin and the plug connector member of each contact element are preferably formed with plug shoulders.

By providing the contact elements as separate components, there is no direct physical connection of the connecting elements with the contact elements anymore, but the contact elements are connected over a plug connector member with the associated connecting element. Such a plug connector member, in turn, is connected as one piece with a contact pin to be connected thereto. When connecting cable wires to the connecting elements, the connect force will not be transferred between the connecting elements and the plug connector member, as the plug connector element is movable relative to the connecting element. Thus, the connect force will also not be transferred to the contact pin of the contact element, so that there is no risk any more of damage at the solder position when connecting the connecting elements with cable wires. Similar considerations apply for the disconnect procedure.

In the preferred embodiment, the plug connector element, for connecting elements made from flat material, is formed as a fork-type contact which is displaceable slidingly on a flat section of the connecting element. For limiting the penetration depth of the separate contact element in the plastic housing of the connector element, a plug shoulder is formed between the contact pin and the plug connector element of each contact element.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
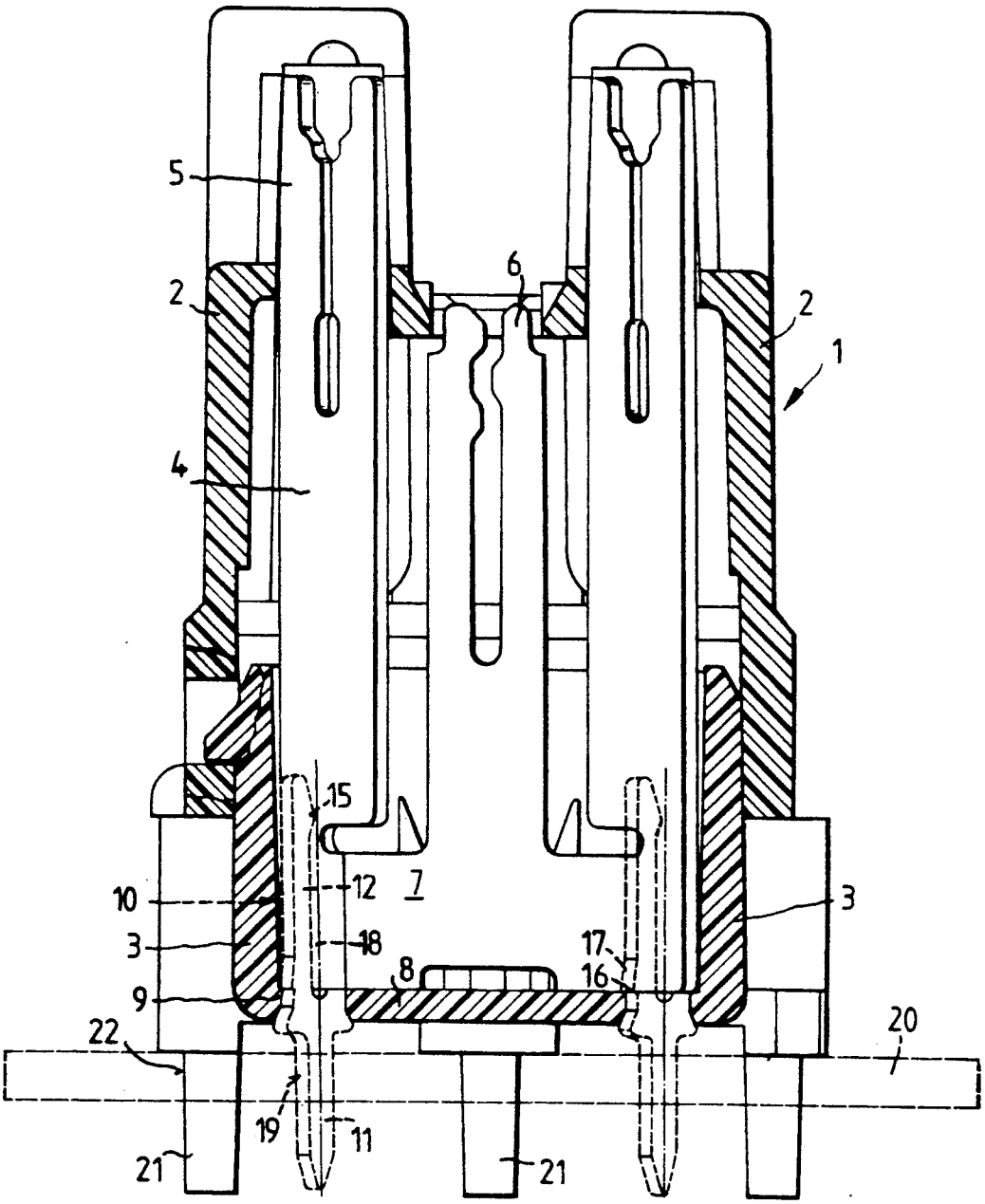
FIG. 1 is a cross sectional view taken through a connector bank with connecting contacts.

The connector bank according to FIG. 1 comprises a plastic housing 1, an upper housing section 2 and a lower housing section 3. The upper housing section 2 is snap-fitted with the lower housing section 3. Into the plastic housing 1 there are fitted connecting elements 4 of flat material. These connecting elements 4 are composed of two cutting/clamping connecting elements 5 to be connected from above with cable wires, and of a center contact 6 connected with each other over a crosspiece 7, arranged at the bottom of the lower housing section 3. The two cutting/clamping connecting elements 5 are arranged under an angle of 45° off the drawing plane shown in FIG. 1. The two contact elements 5 are arranged in parallel to each other.

Figure 5:
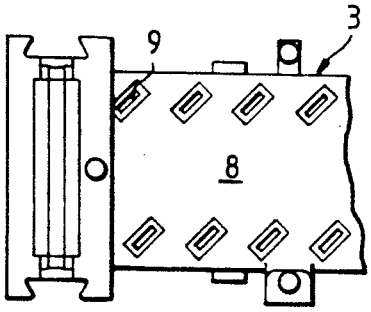
FIG. 5 is a bottom view of a connector bank.

In the bottom 8 of the lower housing section 3 slots 9 are formed, as shown in FIG. 5, in two parallel rows.

Figure 6:
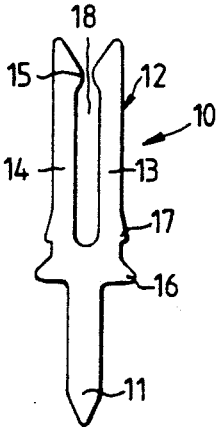
FIG. 6 is a front view of a contact element according to the invention.

Two opposed slots 9 are provided, each belonging to one cutting/clamping connecting element 5. Contact elements 10 can be inserted into the slots 9 from the underside of the plastic housing 1. One of the contact elements 10 is FIG. 6. The contact element 10 is a separate component from the connecting elements 4, and is composed of a contact pin 11 and a plug connector element 12. This structure is formed as one piece (including contact pin 11 and connector element 12) having the shape of a fork-type contact with two resilient arms 13, 14 which are bevelled at their free ends towards the interior and which are provided with contact lugs 15. Two pairs of plug shoulders 16, 17 are formed between the contact pin 11 and the plug connector element 12. These plug shoulders 16, 17 serve for fixing the contact element 10 in position in the bottom 8 of the plastic housing.

As shown in FIG. 1, one contact element 10 each is inserted towards the interior of the housing through a slot 9 in the bottom 8 of the plastic housing 1. The plug shoulders 16, 17 clamp the contact element 10 at the bottom 8. For this purpose, the upper plug shoulders 17 which are disposed at the resilient fork arms 13, 14 are shorter than the plug shoulders 16 which are disposed at the contact pin 11. The fork slot 18 surrounds the lateral section of the flat crosspiece 7 of the connecting element 4. Contact lugs 15 make an electrical contact connection with the connecting element 4.

The contact pins 11 projecting downwardly from the plastic housing 1 serve as solder pins to be fitted in electrical engagement into a borehole 19 assigned to a circuit track of a printed-circuit board 20, where the connector bank 1 is plugged on.

The lower housing section 3 of the plastic housing 1 comprises two additional plastic pins 21 penetrating further boreholes 22 of the printed-circuit board 20 and being subsequently riveted by hot-forming to fix the connector bank rigidly on the printed-circuit board 20.

Figure 2:
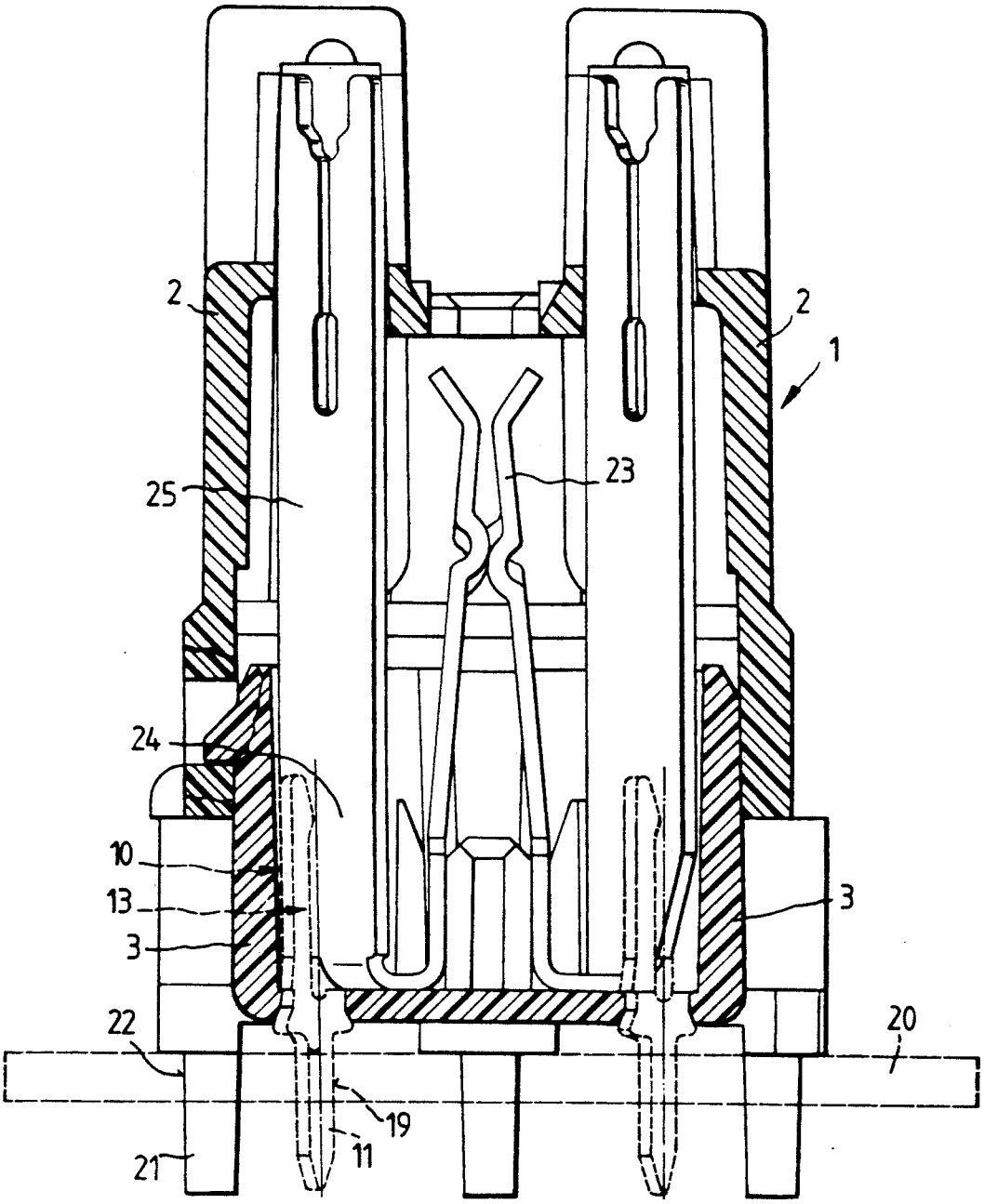
FIG. 2 is a cross sectional view taken through a connector bank with disconnecting contacts.
Figure 3:
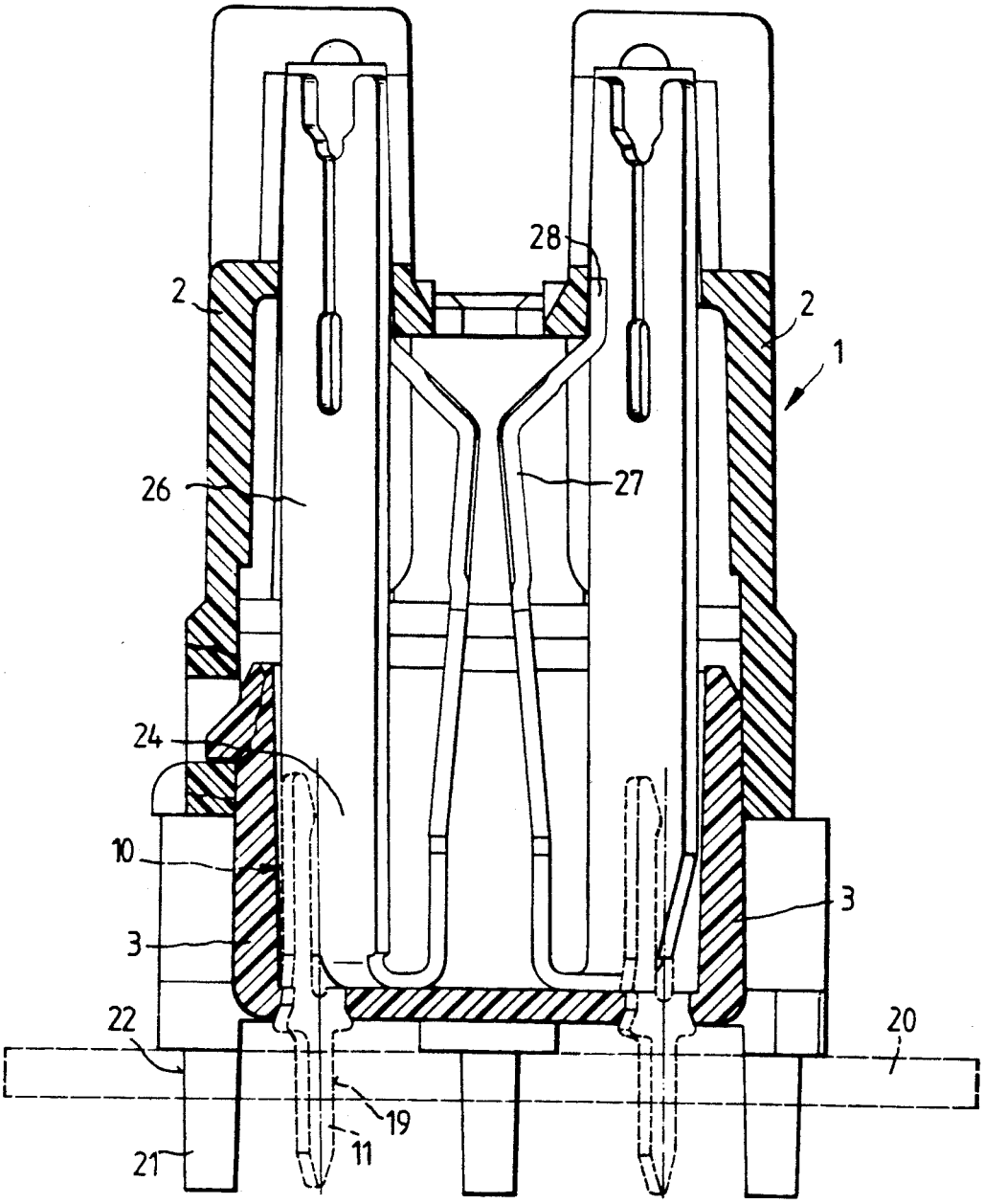
FIG. 3 is a cross sectional view taken through a connector bank with switching contacts.
Figure 4:
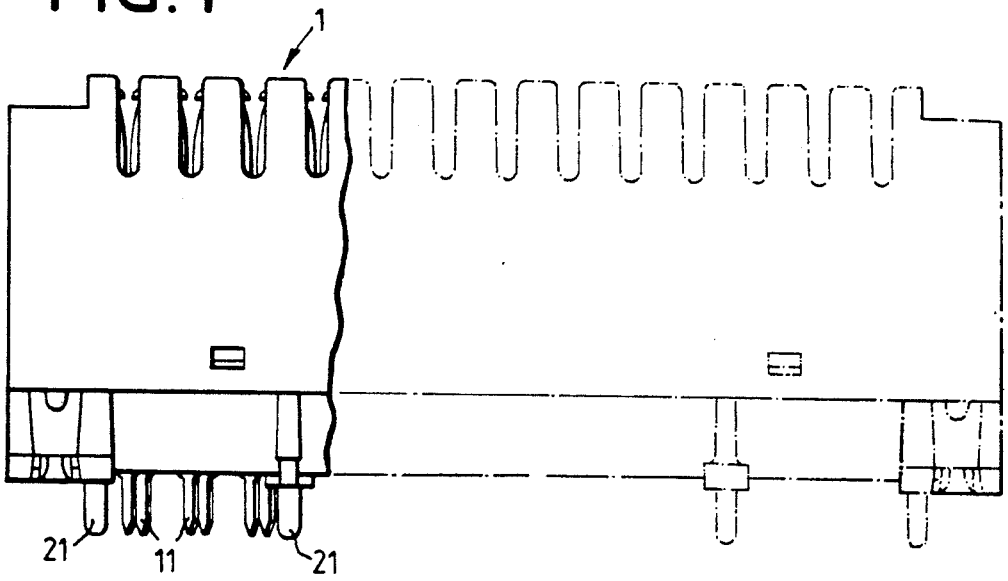
FIG. 4 is a side view of a connector bank.

In the second embodiment of the connector bank shown in FIG. 2, disconnecting elements 25 are provided in place of the connecting element 4. These separating elements comprise central disconnect contact lugs 23. In the third embodiment of the connector bank shown in FIG. 3, switching elements 26 are provided in place of the connecting elements 5. These switching elements comprise central connecting positions 27 which are held spaced apart by bent-off sections 28 resting against the inner surfaces of the housing. In both embodiments, the foot section 24 of the disconnecting or switching elements 25, 26 has a flat section, where the fork-type contact 12 of the contact elements 10 can be plugged on. After assembly of a connector bank provided with usual connecting elements 5 or with disconnecting elements 25 or with switching elements 26, the contact elements 10 can optionally be inserted through slots 9 of the plastic housing 1. Thus,, no modification of usual connecting elements 4, disconnecting elements 25 or switching elements 26 is necessary.

While specific embodiments of the invention have been shown and described in detail to illustrate the application of the principles of the invention, it will be understood that the invention may be embodied otherwise without departing from such principles.

What is claimed is:

1. A connector bank between a wire and a circuit board, the connector comprising:

a connecting element formed of flat sheet metal and having cutting/clamping members on one end, said cutting/clamping members defining a slot for receiving the wire, said slot having edges for making electrical contact with the wire, said cutting/clamping members being forced apart during said electrical contact and applying said force to said connecting element, said connecting element extending downwardly toward the circuit board and receiving said force from said cutting/clamping members during said electrical contact;

contact means for forming an electrical connection to the circuit board, said contact means having a plug connector means forming an electrical connection between said contact means and said connecting element, said plug connector means having a contact range allowing relative movement between said contact means and said connecting element thereby preventing said force applied to said connecting element from reaching said contact means;

said plug connector means forming a fork-type contact surrounding a portion of said flat sheet metal for sliding contact upon said application of said force to separate said cutting/clamping members; and a housing securely holding said connecting element, said housing being fastened to the circuit board and absorbing said for supply to said connecting element by said cutting/clamping members.

2. A connector in accordance with claim 1, wherein:

said connector means forms a slidable connection between said connecting element and the wire, whereby said connecting element and the wire slide together.

3. A connector in accordance with claim 1, wherein said plug connector means forms a slidable connection between said connecting element and said contact means, whereby said connecting element and the contact means are formed to slide together and create an electrical connection when said connecting element and said contact means are slid together.

4. A connector in accordance with claim 1, wherein:

said plug connector means can form said electrical connection between said contact means and said connecting element before said connector means forms said electrical connection between said connecting element and the wire.

5. A connector in accordance with claim 1, wherein:

said connector means can repetitively electrically connect and disconnect said connecting element and the wire, with an amount of effort for connecting being substantially equal to an amount of effort for disconnecting.

6. A connector in accordance with claim 1, wherein:

said connector means is moveable with respect to said contact means for said blocking of said force applied to said connecting element when the wire is connected to said connecting element, while still maintaining said electrical connection between said contact means and said connecting element.

7. A connector in accordance with claim 1, wherein:

said connector means has cutting/clamping elements on said connecting element, said cutting/clamping elements defining a slot means for receiving the wire and making said electrical connection between said connecting element and the wire.

8. A connector in accordance with claim 1, wherein:

a portion of said contact means is movably located in said housing.

9. A connector bank between a wire and a circuit track on a circuit board, the connector comprising:

connecting means for an electrical connection to the electric wire, said connecting means being formed of a flat material element having a cutting/clamping contact with clamping members, which separate by force to form said electrical connection to the electric wire; and contact element means for electrical connection between the circuit board and said connecting means, said contact element means being separate from said connecting means and said contact element means having a contact pin portion and a plug connector portion, said plug connector portion forming a fork-type contact surrounding a portion of said flat portion material element for sliding contact upon application of said force to separate said clamping members.

10. A connector bank according to claim 9, wherein said contact pin portion and said plug connector portion of said contact element means are formed with plug shoulders.

11. A connector in accordance with claim 9, further comprising:

a housing securely holding said connecting means, said housing being fastened to the circuit board for absorbing said force applied to said connecting means.

12. A connector bank between a wire and a circuit board, the connector comprising:

a connecting element having connector means for forming an electrical connection between said connecting element and the wire, said forming of said electrical connection requiring a force to be applied to said connecting element;

contact means for forming an electrical connection to the circuit board, said contact means having a plug connector means forming an electrical connection between said contact means and said connecting element, said plug connector means having a contact range for relative movement between said contact means and said connecting element thereby preventing said force applied to said connecting element from reaching said contact means, said plug connector means has resilient fork arms; and a housing securely holding said connecting element, said housing being fastened to the circuit board and absorbing said force applied to said connecting element during said forming of said electrical connection.

* * * * *